United States Patent [19]

Kwong

[11] 4,323,709

[45] Apr. 6, 1982

[54] PREPARATION OF POLYMERIC REACTION PRODUCTS OF POLY(ALKOXYALKYLENE)AMINES AND EPIHALOHYDRINS

[75] Inventor: Gary W. Y. Kwong, Racine, Wis.

[73] Assignee: UOP Inc., Des Plaines, Ill.

[21] Appl. No.: 197,306

[22] Filed: Oct. 15, 1980

Related U.S. Application Data

[63] Continuation-in-part of Ser. No. 92,386, Nov. 8, 1979, Pat. No. 4,252,746.

[51] Int. Cl.[3] ..... C07C 85/04; C07C 89/02

[52] U.S. Cl. ..... 564/476; 564/477

[58] Field of Search ..... 564/476, 477, 475

[56] References Cited

U.S. PATENT DOCUMENTS

| | | | |
|---|---|---|---|
| 1,790,042 | 1/1931 | Eisleb | 564/476 X |
| 3,257,250 | 6/1966 | Perry et al. | 564/476 X |
| 3,424,681 | 1/1969 | Stanford | 564/483 X |
| 3,499,930 | 3/1970 | Wakeman et al. | 564/297 |
| 3,567,659 | 3/1971 | Nagy | 564/476 X |
| 3,636,114 | 1/1972 | Tobler et al. | 564/292 |
| 3,855,158 | 12/1974 | Petrovich et al. | 564/476 X |
| 3,855,299 | 12/1974 | Witt | 564/476 |
| 4,140,798 | 2/1979 | Merianos et al. | 564/476 X |
| 4,178,434 | 12/1979 | Langdon | 564/505 X |

*Primary Examiner*—John Doll

*Attorney, Agent, or Firm*—James R. Hoatson, Jr.; Eugene I. Snyder; William H. Page, II

[57] ABSTRACT

Novel polymeric products are formed in the process which comprises commingling one molar proportion of a poly(oxyalkylene)amine with from about 0.5 to about 2.0 molar proportions of an epihalohydrin. Epichlorohydrin is the epihalohydrin of choice.

6 Claims, No Drawings

PREPARATION OF POLYMERIC REACTION PRODUCTS OF POLY(ALKOXYALKYLENE)AMINES AND EPIHALOHYDRINS

CROSS REFERENCE TO RELATED APPLICATION

This application is a continuation-in-part of our copending application, Ser. No. 92,386, filed Nov. 8, 1979, now U.S. Pat. No. 4,252,746, all of which is incorporated herein by reference.

BACKGROUND OF THE INVENTION

Various types of petroleum-derived hydrocarbon oils undergo deterioration on storage or upon exposure to severe conditions. Thus fuel oils such as gasoline, diesel fuel, jet fuel, other aviation fuel, burner oil, furnace oil, kerosene, and naphtha, for example, and other oils such as lubricating oils, cutting oils, slushing oils, etc., undergo deterioration as evidenced by such changes as, for example, formation of sediment and discoloration.

Sediment formation is undesirable for various reasons. The settling of accumulated particulates in tanks storing hydrocarbon oils requires periodic draining and cleaning of storage tanks, leading to temporary unavailability of storage capacity, substantial diversion of manpower, and waste disposal problems. Sediment formation in burner oil tends to plug strainers, burner tips, injectors, etc. In diesel fuel such sediment tends to form sludge and varnish in the engine. If the oil is used as a heat exchange medium, as for example with jet fuel, the sediment tends to plug exchanger coils. In gasoline the sediment may tend to deposit on sensitive parts in an internal combustion engine, such as carburetors, thereby decreasing the efficiency of combustion and causing increased fuel consumption.

It is apparent, therefore, that reduced sediment formation in hydrocarbon oils is desirable. One method of effecting such reduction would be to eliminate, to a substantial degree, those processes leading to particulate formation, such as oxidation. Another method would be to prevent agglomeration and/or settling of the formed particulate matter by effectively maintaining the fine particulates in a well dispersed state for when the particulates are so dispersed the aforementioned difficulties associated with sediment formation either do not occur or are of substantially lessened severity.

Discoloration of hydrocarbon oils is undesirable because it is an indication that degradation has occurred or is occurring, hence there is a marked customer preference for lighter oils. Thus there is an economic incentive for minimizing discoloration and degradation of hydrocarbon oils, especially during long-term storage.

SUMMARY OF THE INVENTION

This invention relates to a method of preparation of novel reaction products. One embodiment is the process which comprises commingling one molar proportion of a poly(oxyalkylene)amine with from about 0.5 to about 2.0 molar proportions of an epihalohydrin at a temperature from about 40° C. to about 150° C. in the presence of an inorganic base. A more specific embodiment comprises said process wherein the epihalohydrin is epichlorohydrin. A still more specific embodiment comprises said process wherein said poly(oxyalkylene)amine is the diamine from polyisopropylene glycol of molecular weight from about 200 to about 2000 and said epihalohydrin is epichlorohydrin.

DESCRIPTION OF THE INVENTION

The process of this invention is a method of preparing polymeric reaction products of poly(alkoxyalkylene)amine with an epihalohydrin formed at a reaction temperature of from about 40° C. to about 150° C. in the presence of an inorganic base. Such reaction products have a broad range of uses, as is described within. Additionally, such reaction products generally have relatively low pour points and viscosities. Such attributes are desirable in ease of handling and utilizing these materials in their perceived uses. For example, additives for hydrocarbon oils frequently are metered into the oil by pumping under a wide range of temperatures, and it is desirable that such additives remain liquid and pourable, with not too high a viscosity at low temperatures, to ensure pumpability.

As mentioned previously, the process of this invention affords polymeric products of a poly(alkoxyalkylene)amine with an epihalohydrin formed under reaction conditions described within. The reaction frequently is conducted in a high-boiling, unreactive solvent to moderate the exothermic reaction and for ease of manipulation, both during the reaction and afterwards. However, the use of a solvent, where such use is undesirable, may be eliminated although the results may not be necessarily equivalent. Among the solvents which may be used are included toluene, xylene, mesitylene, ethylbenzene, propylbenzene, and other alkylated and polyalkylated aromatics as examples of suitable high-boiling but unreactive materials.

The poly(oxyalkylene)amines suitable for use in this invention include monoamines and diamines. Such amines may be regarded as the reaction products of a poly(oxyalkylene) glycol with ammonia, in which either both available hydroxyl groups are aminated to give diamines, or in which one available hydroxyl group is etherified and the other is aminated to give monoamines. Such poly(oxyalkylene)amines may be represented by the structure $A\text{-}(R_1O)_n\text{-}RNH_2$.

The moiety R of the poly(oxyalkylene)amines used in this invention is an alkylene group containing from 2 to about 10 carbon atoms. Examples of alkylene groups which are suitable include ethylene, propylene, butylene, amylene, hexylene, heptylene, octylene, nonylene, and decylene. Such alkylene groups may be linear or branched alkylene groups. Examples of branched alkylene groups which may be employed in this invention include isopropylene, sec-butylene, iso-butylene, sec-amylene, iso-amylene, etc. In one preferred embodiment R is an ethylene group whereas in another preferred embodiment R is an isopropylene group.

The moieties $R_1$ may each be independently selected from the group consisting of alkylene groups containing from 2 to about 10 carbons, either linear or branched, and otherwise conforming to the description given above for the moiety $R_1$. The number of oxyalkylene moieties present, n, may vary from about 2 to about 50 or more. Each of the groups $R_1$ may be the same or different. In one embodiment all oxyalkylene groups are the same, i.e., each $R_1$ is identical. In another embodiment a chain of identical oxyalkylene moieties is flanked on one or both sides by one or more other oxyalkylene groups, to afford a partial structure which may be represented as:

$$(R_2O)_a\text{-}(R_1O)_b\text{-}(R_3O)_c$$

where a+b+c=n, $R_2$ and $R_3$ are moieties of the same class as $R_1$, but where either $R_2$ or $R_3$, or both, are different from $R_1$ and may be different from each other. Alkylene groups which are particularly preferred are ethylene and isopropylene groups.

The moiety A of the poly(oxyalkylene)amines used in the reaction of this invention may be the amino group, $H_2N$. In such an instance the poly(oxyalkylene)amine employed in this invention is a diamine which may result from the amination of both hydroxyl groups of a poly(oxyalkylene) glycol.

The moiety A also may be an alkoxy group. The alkoxy group of said moiety A contains from about 1 to about 40 carbon atoms, but preferably from about 1 to about 20 carbon atoms. Suitable groups representative of the carbonaceous portion of the alkoxy group include methyl, ethyl, propyl, butyl, amyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, etc. Such groups may have their commercial origin in fatty acids and petroleum-derived alcohols, and consequently may be supplied as mixtures. Therefore it is to be understood that amines containing a combination of the aforementioned groups are explicitly within the scope of this invention.

When the carbonaceous portion of the alkoxy groups is derived from fatty acids the major portion is an unbranched aliphatic group. When the carbonaceous portion comes from petroleum-derived olefins, the major portion generally is a branched aliphatic group. In each case minor amounts of unsaturated material may be present. Therefore it is to be understood explicitly that the carbonaceous portion of the alkoxy group of the alkoxyalkylamines of this invention may be comprised of either a major portion of unbranched or branched aliphatic groups which may contain minor amounts of unsaturation.

The moiety A also may be derived from trimethylolpropane. In such an instance A may be represented as:

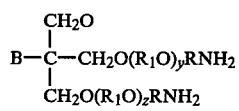

where R and $R_1$ conform to the description given them previously, and y and z are integers from 1 to about 10. The moiety B may be hydrogen or an alkyl group containing from 1 to about 10 carbon atoms.

The amine or mixture of amines is reacted with an epihalohydrin. Epichlorohydrin is preferred, although epibromohydrin and epiiodohydrin may be used, but not necessarily with equivalent results in every case. Other epihalohydrins which may be employed in this invention include 1-chloro-3,4-epoxybutane, 1-chloro-2,3-epoxybutane, 1-chloro-4,5-epoxypentane, 1-chloro-3,4-epoxypentane, etc., and the corresponding bromo and iodo compounds. Suitable condensation products may also be obtained when using a mixture of epihalohydrins, where each of the components meet the qualifications set forth above. The amount of epihalohydrin used ranges from about 0.5 to about 2 moles per mole of amine.

In one embodiment the process of this invention is effected by cotacting the epihalohydrin and amine, generally in a high boiling aromatic solvent, at a suitable temperature, and removing formed inorganic halide with an inorganic base. Generally the reaction may be conducted at a temperature from about 40° C. to about 150° C., the preferred temperature range being from about 60° C. to about 120° C. Inorganic bases suitable for use include the alkali metal hydroxides and carbonates, the alkaline earth oxides, hydroxides, and carbonates. Examples of such materials, cited for illustrative purposes only, are the hydroxides and carbonates of lithium, sodium, potassium, rubidium and cesium, magnesium oxide, magnesium hydroxide, magnesium carbonate, calcium oxide, calcium hydroxide, calcium carbonate, barium oxide, barium hydroxide, and barium carbonate. Where the epihalohydrin is used in up to equal molar proportions of the amine, then the molar amount of base employed is approximately equal to that of the amine, although a small excess of base over amine up to about 50% often may be employed advantageously. Where the epihalohydrin is used in greater than molar proportions relative to amine, then the molar amount of base is about equal to that of the epihalohydrin although a small excess up to about 50% may be used.

The mode of preparation of the condensation products of this invention is susceptible to numerous variations on the theme of reacting the amine with the epihalohydrin under reaction conditions. An example of one general mode is the addition of epihalohydrin to a solution of the amine in a suitable solvent, generally a high-boiling aromatic compound or mixtures thereof. Reaction between the components occurs to a given acidity, or given amount of amine hydrohalide formation, at which stage either aqueous or solid base is added to remove the inorganic halide thus formed. The primary reaction product therefrom undergoes further condensation leading to the ultimate reaction product.

An example of another mode of preparation is the concurrent addition of epihalohydrin and amine to the solvent employed at a suitable temperature. When reaction has occurred to a desired amount of acidity, aqueous or solid base is added and the primary reaction product thereupon undergoes further condensation leading to the ultimate reaction product.

In still another method of preparation, the epihalohydrin and amine are added concurrently to the solvent containing a portion of the base employed. The base may be either in solution or as a solid. After reaction has occurred to a given amount of acidity the remaining portion of solid or aqueous base is added and the primary reaction product thereupon undergoes further condensation leading to the ultimate reaction product.

The materials formed in the process of this invention have been shown to be good dispersants of particulates while being poor dispersants of water. This combination of properties is an excellent one for use of these materials as sedimentation inhibitors of hydrocarbon oils, especially fuel oils. Additionally, the materials described herein show substantial inhibition of discoloration in hydrocarbon oils. Thus these materials are superior additives for preserving quality of hydrocarbon oils upon storage, especially at elevated temperatures for relatively long periods of time. The polymeric reaction products of this invention may also be anticipated to have significant potential as corrosion inhibitors, carburetors, carburetor detergents, antifoulants, lubricant additives, etc.

The following examples are merely illustrative of this invention, and it is to be understood that the invention is not necessarily limited thereby.

EXAMPLE I

The amine used was methoxy poly(isopropyleneoxy)isopropylene amine, of approximate formula $CH_3O—(—CH_2CH(CH_3)O—)_9—CH_2CH(CH_3)NH_2$, and supplied by Jefferson Chemical Co., Inc. as Jeffamine M-600. Epichlorohydrin (9.2 g, 0.10 mol) was added dropwise over one minute to a pale yellow solution of amine at 75° C. in 60 g. Espesol 3BC (high boiling bottoms from zylene fractionation as supplied by Charter Oil Co.) and 2-propanol (20 g). The resulting solution was stirred at 75°-78.5° C. for 1 hour 47 minutes, giving a solution with an acidity 14% of the theoretical maximum. The temperature was raised to 86° C. and kept there for 1 hour 5 minutes, giving a solution with an acidity of 28%. Then 17% aqueous sodium hydroxide solution (25.8 g, 0.110 mol, 10% excess) was added in one portion. The mixture was stirred at 84° C. for 1 hour 10 minutes. The layers were separated. The organic layer was azeotropically distilled with collection of the 2-propanol-water azeotrope. The solution was cooled and suction-filtered, giving a light yellow solution (114.6 g, 92%, 52.7 wt. % active ingredient).

EXAMPLE II

The amine used was of the structure $H_2NCH(CH_3)CH_2—(OCH(CH_3)—CH_2—)_a(—OCH_2CH_2—)_b(—OCH_2CH(CH_3))_cNH_2$, of approximate molecular weight 600, where b is 13-14, and a+c is 3-4. Epichlorohydrin (18.5 g, 0.200 mol) was added dropwise over 6 minutes to a stirred light yellow solution of such amine (60.0 g, 0.200 eq, 0.100 mol) in Espesol 3BC, (70.0 g) and 2-propanol (25.0 g) at 59°-60° C. The temperature was kept at 59°-60° C. for 1 hour. The temperature was raised over 10 minutes and held at 78.5° C. for 2 hours, 9 minutes, giving a solution with an acidity 29% of the theoretical maximum. Then 17% aqueous sodium hydroxide (49.4 g, 0.200 mol, 10% excess) was added over 2 minutes to the stirred solution. The temperature was raised from 71° C. to 79° C. over 40 minutes and kept at 79°-79.5° C. for 30 minutes. The layers were separated, giving a light yellow, cloudy organic layer containing water droplets. The resulting solution was dried by azeotropic distillation with 2-propanol (10.0 g). The resulting solution was filtered, giving a clear, light yellow solution (131.3 g, 90%, 54.2 wt. % active-ingredient by nitrogen-jet gum method, ANSI/ASTM D 381-70 modified in that nitrogen is used as the gas).

EXAMPLE III

The amine was the diaminated product of poly(isopropyleneoxy) glycol, approximate molecular weight 230, containing 3-4 isopropylene units. Epichlorohydrin (17.6 g, 0.19 mol) was added dropwise over 21 minutes to a stirred, almost colorless solution of the amine (46.8 g, 0.20 mol) in Espesol 3BC, (45.0 g) at 75.5°-78.5° C. The temperature was kept at 78.5°-80.5° C. for 14 minutes, raised from 80.5° C. to 86° C. over 9 minutes, and kept at 86°-88° C. for 39 minutes after which an aliquot had an acidity 37% of the maximum theoretical. Then 20% aqueous sodium hydroxide (42.0 g, 0.21 mol, 10% excess) was added to the stirred solution at 84°-87° over 38 minutes. The resulting mixture was stirred at 85°-90.5° C. for 2 hours 7 minutes. The more 20% aqueous sodium hydroxide (3.8 g, 0.019 mol, total 20% excess) was added to the mixture at 90° C. The mixture was stirred at 90°-91° for 31 minutes. The layers were separated. The organic layer was dried by azeotropic distillation with 2-propanol and suction-filtered, giving a clear, pale yellow filtrate (87.8 g, 86%, 45.6 wt. % active-ingredient by nitrogen-jet gum method).

EXAMPLE IV

The amine was of the same structural type as used in the prior example but with the somewhat higher molecular weight of about 400. Epichlorohydrin (3.3 g, 0.090 mol) was added dropwise over 8 minutes to a stirred, very pale yellow solution of the amine (41.0 g, 0.200 eq, 0.100 mol) in Espesol 3BC, (40.0 g) at 75°-75.5° C. The resulting solution was stirred at 75.5°-76° C. for 56 minutes. The temperature was increased in two steps from 75.5° C. to 93° C. over 56 minutes and kept at 93° C. for 6 minutes after which an aliquot had an acidity 32% of the maximum theoretical. Then 20% aqueous sodium hydroxide (19.8 g, 0.099 mol, 10% excess) was added dropwise over 6 minutes to the stirred solution at 93°-88° C. The mixture was stirred at 88°-93° C. for 17 minutes and 93°-94° C. for one hour 10 minutes with some white salt settling to the bottom. Then additional 20% acqueous sodium hydroxide (1.8 g, 0.0090 mol, total exces 20%) was added. The resulting mixture was stirred at 91° C. for 50 minutes. The layers were separated, giving a pale yellow organic layer containing some suspended water. The solution was dried by azeotropic distillation with 2-propanol (20.1 g). The resulting solution was suction-filtered, giving a light yellow solution (65.9 g, 77%, 53.1 wt. % active ingredient by nitrogen-jet gum method).

EXAMPLE V

In this example the amine was a substituted ether of the type.

$$\begin{array}{l} \quad\quad\quad CH_2—(OCH_2CH(CH_3—)_x—NH_2 \\ \quad\quad\quad\quad | \\ C_2H_5—C—CH_2(O—CH_2CH(CH_3)—)_y—NH_2 \\ \quad\quad\quad\quad | \\ \quad\quad\quad CH_2—(OCH_2CH(CH_3—)_z—NH_2 \end{array}$$

where x+y+z had an average value of about 5.3. Epichlorohydrin (8.7 g, 0.094 mol) was added dropwise over 12 minutes to a stirred, pale yellow solution of said amine (44.1 g, 0.30 eq, 0.10 mol) in Espesol 3BC, (47.0 g) at 75°-77° C. The resulting solution was stirred at 77°-78° C. for 14 minutes. The temperature was increased stepwise from 77.5° C. to 94° C. over 45 minutes and maintained there for 13 minutes to an acidity of 44% of the maximum theoretical. Then 20% aqueous sodium hydroxide (21.0 g, 0.105 mol, 10% excess) was added dropwise over 13 minutes to the stirred solution at 94.5°-90° C. The mixture was filtered and the layers were separated. The organic was filtered, giving a clear pale yellow filtrate (87.4 g, 96%, 46.1 wt. % active ingredient by nitrogen-jet gum method).

What is claimed is:

1. The process of making a polymeric reaction product which comprises reacting one molar proportion of a poly(oxyalkylene)amine of the structure $A\text{-}(R_1O)_n\text{-}RNH_2$, wherein (a) R and each $R_1$ are independently selected from the group consisting of alkylene moieties containing from 2 to about 10 carbon atoms;

(b) n is an integer from 2 to about 50;

(c) A is selected from the group consiting of $H_2N$, alkoxy, where the carbonaceous portion contains from 1 to about 40 carbon atoms, and

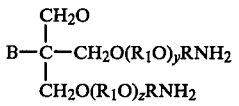

wherein B is selected from the group consisting of hydrogen and alkyl containing from 1 to about 10 carbon atoms, and y, z are integers from 1 to about 10;

with about 0.5 to about 2.0 molar proportions of an epihalohydrin selected from the group consisting of epihalohydrin, 1-halo-3,4-epoxybutane, 1-halo-2,3-epoxybutane, 1-halo-4,5-epoxypentane, and 1-halo-3,4-epoxypentane, at a temperature from about 40° C. to about 150° C., thereafter reacting the resultant adduct with an inorganic base at said temperature, and recovering the polymeric reaction product.

2. The process of claim 1 wherein said epihalohydrin is epichlorohydrin.

3. The process of claim 2 wherein R is selected from the group consisting of ethylene and propylene moieties.

4. The process of claim 2 wherein each $R_1$ is independently selected from the group consisting of ethylene and propylene moieties.

5. The process of claim 2 wherein A is selected from the group consisting of $H_2N$ and alkoxy, where the carbonaceous portion contains from 1 to about 20 carbon atoms.

6. The process of claim 2 wherein the temperature is in the range of from about 60° C. to about 120° C.

* * * * *